US010416597B2

(12) United States Patent
Ishizuka et al.

(10) Patent No.: US 10,416,597 B2
(45) Date of Patent: Sep. 17, 2019

(54) IMAGE FORMING APPARATUS WITH A FAN OPERABLE UNDER NOISE-REDUCIBLE CONTROL

(71) Applicant: Brother Kogyo Kabushiki Kaisha, Nagoya (JP)

(72) Inventors: Daisuke Ishizuka, Nagoya (JP); Yuichi Ikeno, Nagoya (JP); Atsushi Hayakawa, Okazaki (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 16/157,451

(22) Filed: Oct. 11, 2018

(65) Prior Publication Data

US 2019/0187593 A1 Jun. 20, 2019

(30) Foreign Application Priority Data

Dec. 19, 2017 (JP) ..... 2017-243022

(51) Int. Cl.
*G03G 15/00* (2006.01)
*G03G 15/20* (2006.01)
*G03G 21/20* (2006.01)

(52) U.S. Cl.
CPC ..... *G03G 15/2039* (2013.01); *G03G 15/5004* (2013.01); *G03G 21/20* (2013.01)

(58) Field of Classification Search
CPC ..... G03G 15/2039; G03G 15/205; G03G 15/5004; G03G 21/20
See application file for complete search history.

(56) References Cited

U.S. PATENT DOCUMENTS 6,324,361 B1 * 11/2001 Itoh ..... G03G 21/206 399/92
2017/0060203 A1 * 3/2017 Hagiwara ..... G06F 1/206
2017/0096314 A1 * 4/2017 Kakutani ..... G03G 15/5004
2017/0371277 A1 * 12/2017 Oonishi ..... G03G 15/205

FOREIGN PATENT DOCUMENTS

JP H07-028356 A 1/1995
JP H08-129331 A 5/1996

* cited by examiner

*Primary Examiner* — Sophia S Chen
(74) *Attorney, Agent, or Firm* — Burr & Brown, PLLC

(57) ABSTRACT

An image forming apparatus, having a body, a fuser to fix an image on a recording medium by heat, an interface to accept a value for a first time, which is between an end of fixing by the fuser until entry into a low power-consuming condition for the heater, a fan, and a controller, is provided. The controller sets a second time being a predetermined length and subtract the second time from the first time to obtain a third time. If the third time is given a positive value, the controller continues driving the fan after the end of the fixing and throughout the third time, and inactivates the fan after the third time. If the third time is given a value smaller than or equal to zero, the controller inactivates the fan during the first time before the entry into the low power-consuming condition.

17 Claims, 11 Drawing Sheets

IMAGE FORMING APPARATUS WITH A FAN OPERABLE UNDER NOISE-REDUCIBLE CONTROL

CROSS REFERENCE TO RELATED APPLICATION

This application claims priority from Japanese Patent Application No. 2017-243022, filed on Dec. 19, 2017, the entire subject matter of which is incorporated herein by reference.

BACKGROUND

Technical Field

An aspect of the present disclosure is related to an image forming apparatus operable in a lower-power operation mode, in which an amount of power to be consumed is reducible, and in particular to a technique to control a cooling fan in an image forming apparatus.

Related Art

In recent years, in view of environmental concerns and energy-consumption concerns, an image forming apparatus operable in operation modes, in which an amount of power to be consumed may be reduced, such as so-called standby mode and energy-saving mode, has been introduced. The standby mode may mean an operation mode, in which no image is formed, but a fuser to thermally fix an image formed on a sheet in a developing agent thereon is heated. The image forming apparatus operating in the standby mode may shift to an image forming mode, in which an image may be formed on a sheet, as soon as a command to the image forming apparatus to form the image is entered. The energy-saving mode may mean an operation mode, in which no image is formed, and the fuser is not heated. A power consumption amount in the energy-saving mode may be even lower than a power consumption amount in the standby mode.

The image forming apparatus finishing forming an image in the image forming mode may shift to the standby mode, and after standing by for a predetermined length of time, may shift to the energy-saving mode. A length of a time period, between the end of the image forming mode and entry into the energy-saving mode, that is, a length of a time period for standing by in the standby mode, may be set according to a preference of a user.

The image forming apparatus may be equipped with a fan to cool parts and devices inside a body thereof so that the interior of the image forming apparatus may be cooled during the image forming mode and the standby mode, both in which the fuser is heated. For example, an image forming apparatus may maintain a fan running while the operation mode shifts from the image forming mode and through the standby mode until the operation mode shifts to the energy-saving mode so that a temperature in the body of the image forming apparatus may be prevented from increasing during the standby mode.

SUMMARY

While the temperature in the body of the image forming apparatus may be restrained from increasing, the fan continuously running through the standby mode may produce noise. In particular, a sheet conveyer to convey a sheet and an image printer to print an image on the sheet may be suspended inactive during the standby mode; therefore, the noise by the fan may stand even more audible, and a user may find the noise disturbing.

The present disclosure is advantageous in that an image forming apparatus, in which an interior temperature in a body may be prevented from increasing during a standby mode while a noise by a fan may be suppressed, is provided.

According to an aspect of the present disclosure, an image forming apparatus, having a body; a fuser stored in the body, the fuser comprising a heater, the fuser being configured to heat a recording medium, onto which an image is transferred, by the heater to fix the image on the recording medium; an interface configured to accept a value for a first time, the first time being a length of time from an end of fixing the image on the recording medium by the fuser until entry into a low power-consuming condition for the heater; a fan configured to ventilate the body; and a controller configured to set a second time being a predetermined length and obtain a third time, the third time being a remainder of subtraction subtracting the second time from the first time accepted by the interface, is provided. The controller is configured to, in a case where the third time is given a positive value, continue driving the fan after the end of the fixing and throughout the third time, and inactivate the fan after the third time; and in a case where the third time is given a value smaller than or equal to zero, inactivate the fan during the first time before the entry into the low power-consuming condition.

BRIEF DESCRIPTION OF THE ACCOMPANYING DRAWINGS

DETAILED DESCRIPTION

Hereinafter, with reference to the accompanying drawings, described below will be an image forming apparatus 1 according to an embodiment of the present disclosure.

[Overall Configuration of Image Forming Apparatus]

In the following description, directions related the image forming apparatus 1 and parts and items included in the image forming apparatus 1 will be mentioned on basis of a posture of the image forming apparatus 1 in a usable condition as indicated by arrows in FIGS. 1-2. A front-to-rear or rear-to-front direction may be called as a front-rear direction, an up-to-down or down-to-up direction may be called as a vertical direction, and a left-to-right or right-to-left direction may be called as a widthwise direction.

Figure 1:
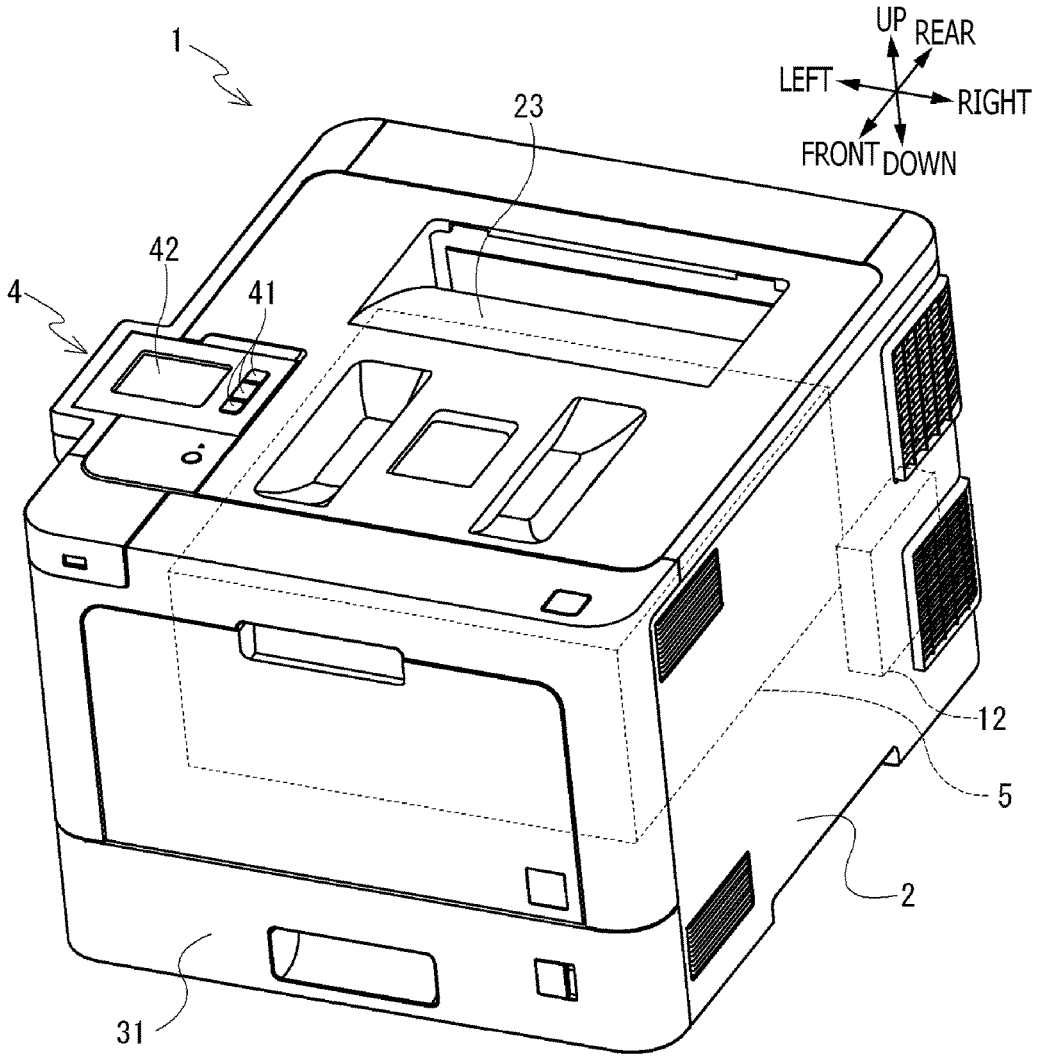
FIG. 1 is a perspective view of an image forming apparatus according to an embodiment of the present disclosure.
Figure 2:
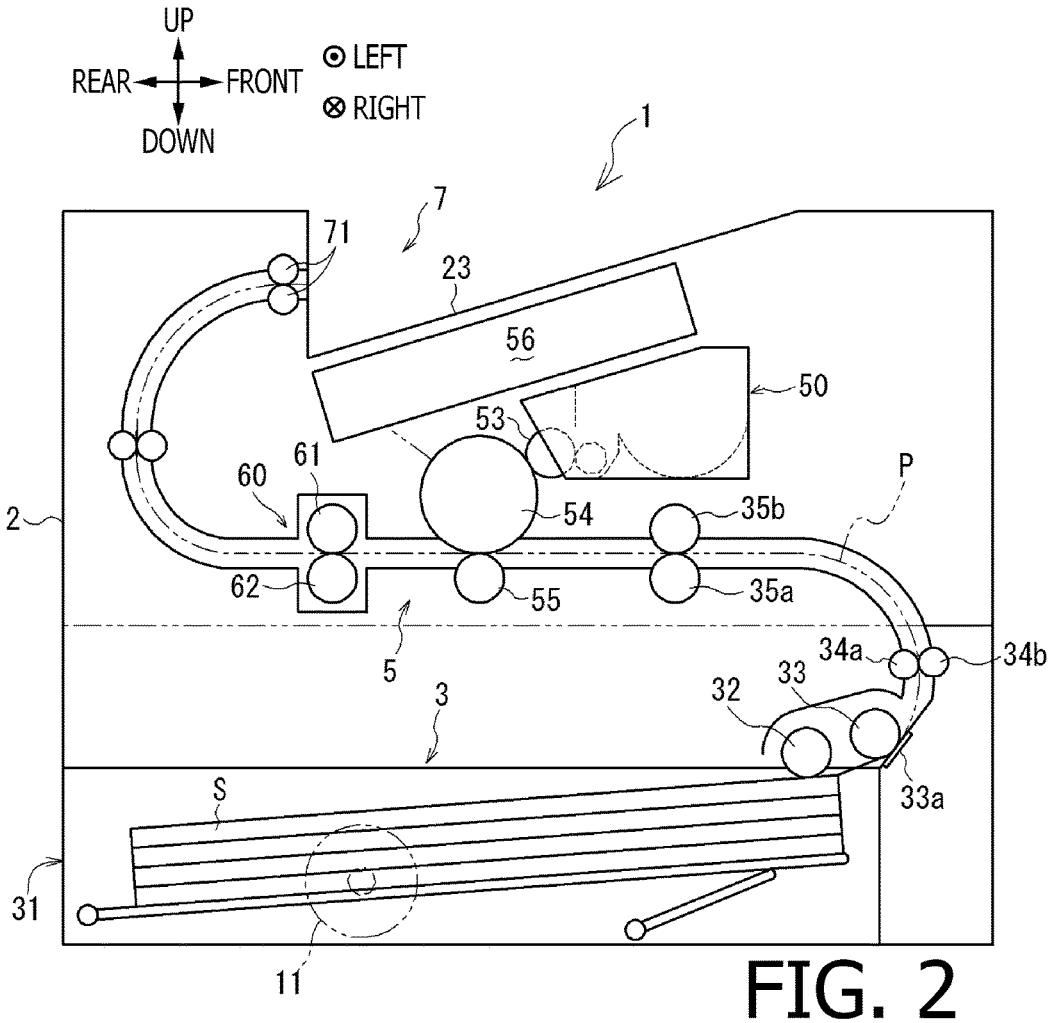
FIG. 2 is a cross-sectional view of the image forming apparatus according to the embodiment of the present disclosure.
Figure 3:
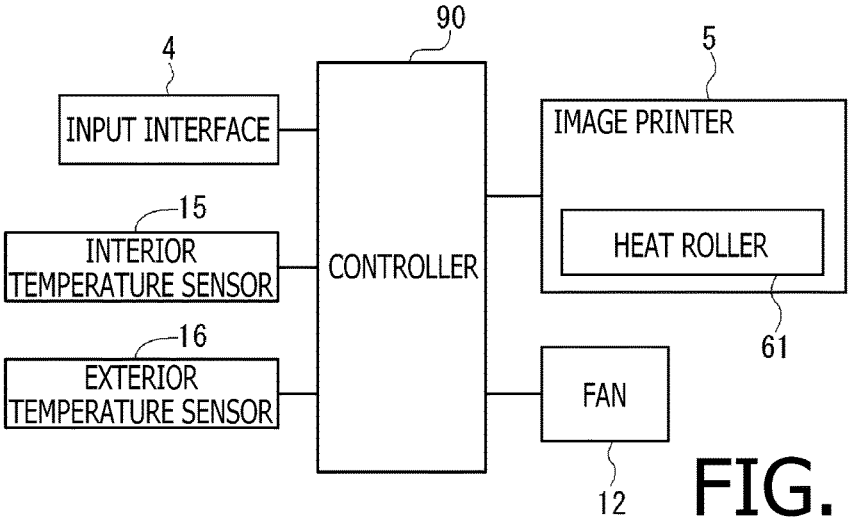
FIG. 3 is a block diagram to illustrate a configuration of the image forming apparatus according to the embodiment of the present disclosure.

As shown in FIGS. 1-3, the image forming apparatus 1 includes a body 2, a sheet feeder 3, an image printer 5, an ejector device 7, an input interface 4, a fan 12, a controller 90, and a motor 11.

The body 2 has a shape of an approximately rectangular box, in which the sheet feeder 3, the image printer 5, the fan 12, the controller 90, and the motor 11 are stored. On an upper face of the body 2, formed is an exit tray 23, in which a sheet S with an image formed thereon exiting the image printer 5 may rest. At a leftward-front area in the upper face of the body 2, arranged is an operation panel 4.

The sheet feeder 3 includes a feeder tray 31 arranged at a lower position in the body 2 to support sheet(s) S therein. The sheet feeder 3 may convey the sheets S from the feeder tray 31 toward the image printer 5. The sheet feeder 3 further includes a feeder roller 32, a separator roller 33, a separator pad 33*a*, a pair of conveyer rollers 34*a*, 34*b*, and a pair of registration rollers 35*a*, 35*b*. Inside the body 2, formed is a conveyer path P, extending from the feeder tray 31 through the image printer 5 to the exit tray 23, in which the sheets S are conveyed.

The sheets S supported by the feeder tray 31 may be separated from one another by the feeder roller 32, the separator roller 33, and the separator pad 33*a* to be fed one-by-one in the conveyer path P. The sheets S may be conveyed in the conveyer path P toward the image printer 5 by the conveyer rollers 34*a*, 34*b*, and the registration rollers 35*a*, 35*b*. The registration rollers 35*a*, 35*b* may regulate movement of the sheet P in the conveyer path P to pause thereat for a predetermined length of time and resume conveyance of the sheet P toward the image printer 5 at a predetermined timing.

The image printer 5 is arranged at an upper position with respect to the sheet feeder 3. The image printer 5 includes a process cartridge 50 to transfer an image onto a surface of the sheet S conveyed from the sheet feeder 3, an exposure device 56 to emit light at a photosensitive drum 54, and a fuser 60 to fix the image transferred onto the sheet S in the process cartridge 50 thereon.

The process cartridge 50 includes a developing roller 53, the photosensitive drum 54, and a transfer roller 55.

The exposure device 56 includes a laser diode, a polygon mirror, a lens, and a reflector mirror, which are not shown. The exposure device 56 may emit a laser beam at the photosensitive drum 54 based on image data input in the image forming apparatus 1 to expose a surface of the photosensitive drum 54 to the laser beam.

The photosensitive drum 54 is arranged to adjoin the developing roller 53. The surface of the photosensitive drum 54 may be positively charged evenly by a charger, which is not shown, and thereafter exposed to the laser beam from the exposure device 56 selectively according to the image data. In the areas on the surface of the photosensitive drum 54 selectively exposed to the laser berm, a level of electrical potentials may be lowered compared to the other areas that are not exposed to the laser beam. Thus, an electrostatic latent image based on the image data may be formed on the surface of the photosensitive drum 54. Meanwhile, a positively charged developer agent, e.g., toner, may be supplied to the electrostatic latent image on the surface of the photosensitive drum 54 so that the electrostatic latent image may be developed to be a toner image.

The transfer roller 55 is arranged to face the photosensitive drum 54, and a bias applier, which is not shown, may apply negative transferring bias to the transfer roller 55. With the transferring bias being applied to the surface of the transfer roller 55, when the sheet S is conveyed through a position between the transfer roller 55 and the photosensitive drum 54, on which the toner image is formed, the toner image on the surface of the photosensitive drum 54 may be transferred onto a surface of the sheet S.

The fuser 60 includes a heat roller 61 and a pressure roller 62. The heat roller 61 may be heated by power supplied from a power source, which is not shown, and rotated by a driving force from the motor 11. The pressure roller 62 is arranged to contact the heat roller 61 and may rotate along with the rotation of the heat roller 61. When the sheet S with the toner image transferred thereon is conveyed to the fuser 60, the heat roller 61 and the pressure roller 62 may nip the sheet S at a position there-between, and the heat roller 61 may heat the sheet S so that the toner image may be fused and fixed onto the sheet S. Thus, the image may be formed on the sheet S.

The ejector device 7 includes a pair of ejection rollers 71, 71, which may eject the sheet S conveyed from the fuser 60 outside the body 2. In particular, the ejection rollers 71, 71 may eject the sheet S conveyed from the fuser 60 at the exit tray 23 formed on the upper face of the body 2.

The input interface 4 includes an operation interface 41 and a display 42. The operation interface 41 may include operation keys and buttons, through which commands and information may be input in the image forming apparatus 1. The display 42 may display information concerning the image forming apparatus 1, including a condition of the image forming apparatus 1 and services available by the image forming apparatus 1. The display 42 may include a touch panel that provides a function of an input operating interface.

The fan 12 may be driven by power from the power source, which is not shown, to ventilate the body 2 of the image forming apparatus 1.

The controller 90 may control heating actions in the heat roller 61 and activation of the fan 12. As shown in FIG. 3, the controller 90 is connected with the input interface 4, the image printer 5, and the fan 12. The image forming apparatus 1 includes an interior temperature sensor 15 to measure a temperature inside the body 2 and an exterior temperature sensor 16 to measure a temperature outside the body 2. The interior temperature sensor 15 and the exterior temperature sensor 16 are connected with the controller 90.

[Operation Modes for the Image Forming Apparatus]

Operation modes, in which the image forming apparatus 1 is operable, includes, but not necessarily be limited to, an image forming mode, a standby mode, and a sleep mode.

The image forming mode is an operation mode, in which the heat roller 61 is heated, and the image printer 5 may form an image on a sheet S. The standby mode is an operation mode, in which the image printer 5 is not forming an image, but the heat roller 61 is heated, so that the image forming apparatus 1 may shift to the image forming mode promptly when an activation command to the image forming apparatus 1 to form an image is entered. The sleep mode is an operation mode, in which the image printer 5 is not forming an image, and the heat roller 61 is not heated.

The image forming apparatus 1 may enter the image forming mode when the activation command is input and exit the image forming mode to shift to the sleep mode after a predetermined length of time since the exit from the image forming mode. The standby mode may start when the image forming mode ends and last until the image forming apparatus 1 shifts to the sleep mode. In other words, the operation mode in the image forming apparatus 1 shifts to the standby mode when the image forming mode ends and thereafter shifts to the sleep mode after the standby mode lasts for a predetermine length of time.

While the image forming apparatus 1 is in the standby mode, the image printer 5 is not activated; therefore, an amount of power consumption is lower than an amount of power consumption in the image forming mode. While the image forming apparatus 1 is in the sleep mode, the image printer 5 is not activated, and the heat roller 61 is not heated; therefore, an amount of power consumption in the sleep mode is even lower than the power consumption amount in the standby mode. The sleep mode may be in other words called as an energy-saving mode.

The heat roller 61 is heated to a first heated temperature when the image forming apparatus 1 is in the image forming mode. The first heated temperature is a temperature of heat, by which the developer agent transferred onto the sheet S may be fused to be fixed thereon. The first heated temperature may be, but not necessarily be limited to, 190 degrees C. In this regard, the heat roller 61 may not necessarily be constantly heated during the image forming mode as long as the temperature in the heat roller 61 stays at 190 degrees C. Meanwhile, during the standby mode, the heat roller 61 is heated to a second heated temperature, which is a temperature lower than or equal to the first heated temperature. The second heated temperature may be, when it is set to be lower than the first heated temperature, for example, 150 degrees C. In this regard, the heat roller 61 may not necessarily be constantly heated during the standby mode as long as the temperature in the heat roller 61 stays at 150 degrees C.

The image forming mode may end when the fuser 60 finishes fusing the image in the developer agent onto the sheet S.

Figure 4A:
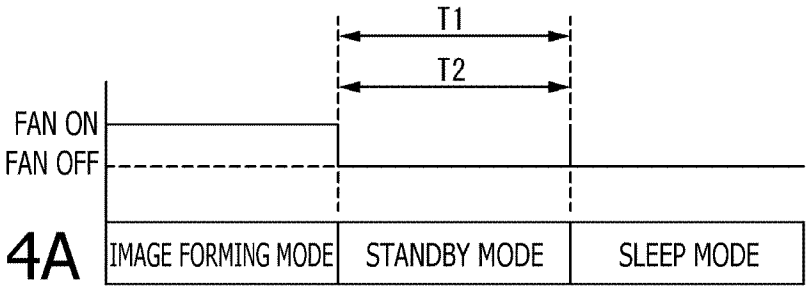
FIG. 4A-4C illustrate lengths of a time period and activation control of a fan in the image forming apparatus according to the embodiment of the present disclosure.
Figure 4B:
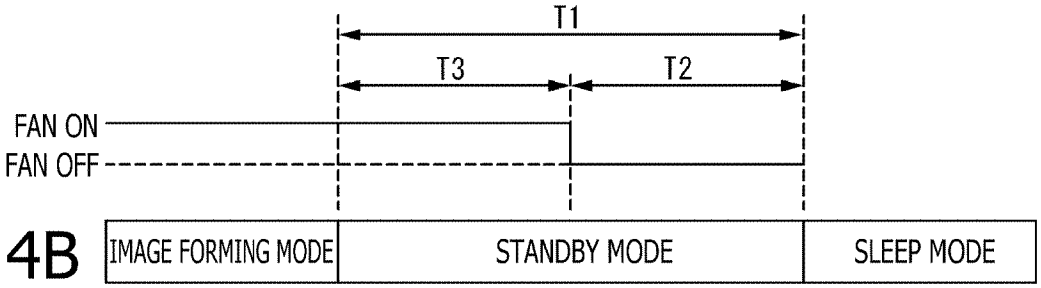
Figure 4C:
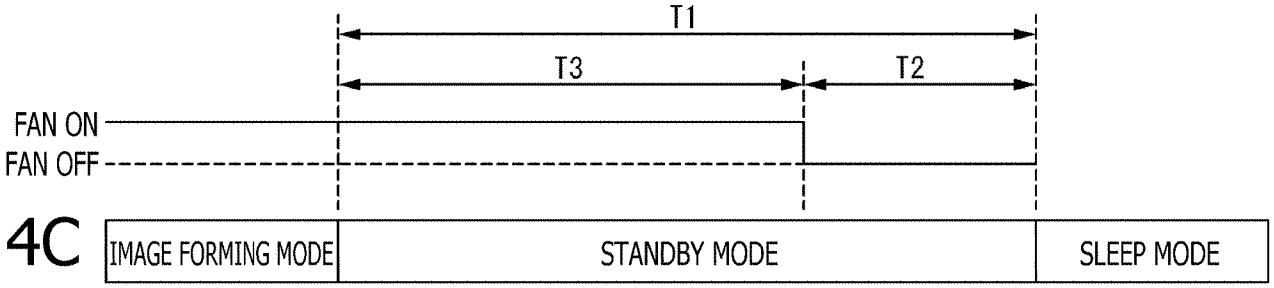

As shown in FIGS. 4A-4C, a length of a time period between exit of the image forming mode and entry into the sleep mode, that is, a lapse of the standby mode, is set at a first time T1. The first time T1 may be set or modified by a user. For example, the user may input a preferred length of time for the first time T1 through the input interface 4.

An initial length for the first time T1 is set in advance as a default setting in the controller 90. Therefore, if the user does not input any preference for the first time T1 through the input interface 4, in other words, if no preference by the user is not accepted through the input interface 4, the initial length serves as the first time T1. On the other hand, if the user inputs a preference for the first time T1 through the input interface 4, the input interface 4 may accept the preference, and the inputted length serves as the first time T1.

In the image forming mode, the temperature in the body 2 may tend to increase because of the heat roller 61 being heated. Therefore, the controller 90 activates the fan 12 to feed the air to cool the interior of the body 2 to prevent the temperature from increasing. The controller 90 may control a rotation speed of the fan 12 according to the temperature in the body 2.

In the standby mode, the controller 90 may control behaviors of the fan 12 based on the length of the first time T1, a length of time elapsed since the entry into the standby mode, and the current temperature in the body 2 to restrain the temperature in the body 2 from increasing.

The heat roller 61 is heated during the standby mode. When the first time T1 elapses, the controller 90 shifts from the standby mode to the sleep mode, in which heat supply to the heat roller 61 is discontinued. In this regard, in a certain time range within the standby mode, the fan 12 may be inactivated to stop running before the first time T1 elapses as long as the temperature in the body 2 is restrained from increasing. Therefore, the time range within the standby mode, in which the temperature in the body 2 is prospected to stay at the predetermined temperature without increasing even if the fan 12 is inactivated, is set in advance as a second time T2.

In the sleep mode, the controller 90 may control activation of the fan 12 based on a length of the time lapse since entry into the sleep mode and the temperature in the body 2.

The fan 12 is drivable at different rotation speeds. For example, the controller 90 may drive the fan 12 at one of a first rotation speed, a second rotation speed being higher than the first rotation speed, and a third rotation speed being lower than the first rotation speed. The first rotation speed may be a rotation speed when the fan 12 is driven by a voltage of 15V. The second rotation speed may be a rotation speed when the fan 12 is driven by a voltage of 25V. The third rotation speed may be a rotation speed when the fan 12 is driven by a voltage of 12V.

[Controlling Behaviors of the Fan]

In the following paragraphs, described will be behaviors of the fan 12 in each of the operation modes controlled by the controller 90.

<Fan Behavior Control in the Image Forming Mode>

In the image forming mode, in which an image may be formed on the sheet S, the fan 12 is driven to run active constantly. The controller 90 controls the rotation speed of the fan 12 in the image forming mode based on the temperature in the body 2.

Figure 5:
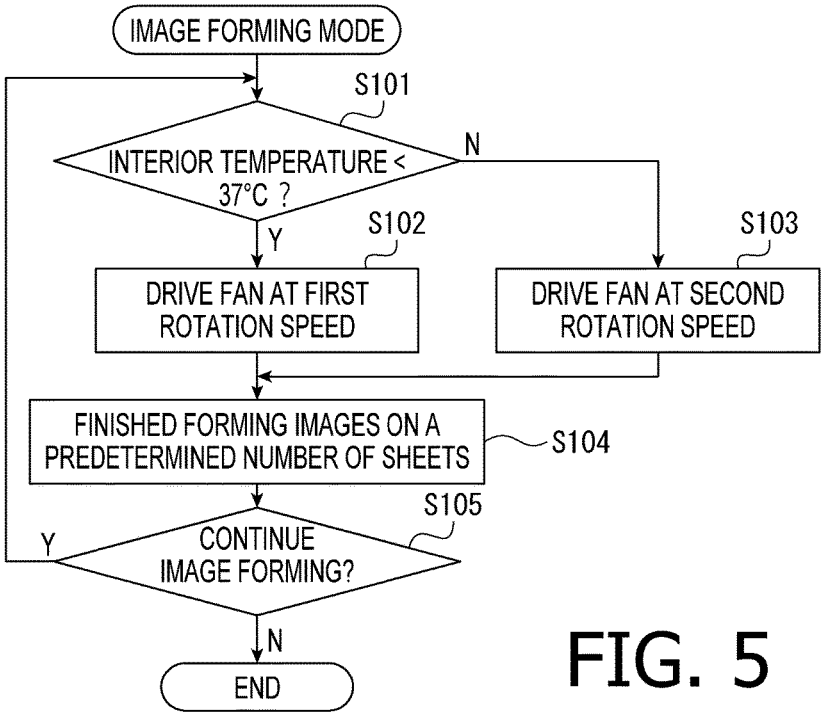
FIG. 5 is a flowchart to illustrate an exemplary flow of steps to control the fan in an image forming mode in the image forming apparatus according to the embodiment of the present disclosure.

As shown in FIG. 5, as the controller 90 enters the image forming mode, in S101, the controller 90 determines whether the temperature in the body 2 measured by the interior sensor 15 is lower than 37 degrees C. If the controller 90 determines that the temperature in the body 2 is lower than 37 degrees C. in S101 (S101: YES), in S102, the controller 90 drives the fan 12 at the first rotation speed.

On the other hand, if the controller 90 determines that the temperature in the body 2 is not lower than 37 degrees C., in other words, the temperature is higher than or equal to 37 degrees C. (S101: NO), in S103, the controller 90 drives the fan 12 at the second rotation speed.

Following S102, in S104, the image printer 5 finishes forming images on a predetermined number of sheets S. Thereafter, in S105, the controller 90 determines whether the image printer 5 will further form an image continuously. If the controller 90 determines that the image printer 5 will not continuously form an image, in other words, if the image printer 5 finished forming images (S105: NO), the controller 90 exits the image forming mode. On the other hand, if the controller 90 determines that the image printer 5 continuously forms an image (S105: YES), the flow returns to S101 and repeats the steps onward.

Following S103, on the other hand, in S104, when the image printer 5 finishes forming images on the predetermined number of sheets S, in S105, the controller 90 determines whether the image printer 5 will further form an image continuously. If the controller 90 determines that the image printer 5 will not continuously form an image, in other words, if the image printer 5 finished forming images (S105: NO), the controller 90 exits the image forming mode. If the controller 90 determines that the image printer 5 continuously forms an image (S105: YES), the flow returns to S101 and repeats the steps onward.

Thus, when the temperature in the body 2 is in a normal lower range, which is lower than 37 degrees C., the controller 90 drives the fan 12 at the first rotation speed. Meanwhile, when the temperature in the body 2 is increased to be higher than or equal to 37 degrees C., the controller 90 drives the fan 12 at the second rotation speed, which is higher than the first rotation speed, to cool the interior of the body 2 to prevent the temperature from increasing. When the temperature in the body 2 is not as high as 37 degrees C., the controller 90 drives the fan 12 at the first rotation speed, which is lower than the second rotation speed, so that a level of the noise produced by the fan 12 may be lowered.

According to the flow described above, the controller 90 determines whether the fan 12 should be driven at the first rotation speed or the second rotation speed each time when the images are formed on the predetermined number of sheets S (S101-S103). Therefore, even when the temperature in the body changes while the images are being formed, the fan 12 may be driven at a rotation speed stably.

<First Embodiment of Fan Behavior Control in the Standby Mode>

In the standby mode between the image forming mode and the sleep mode, behaviors of the fan 12 are controlled by the controller 90 based on the length of the first time T1 and the length of the time elapsed since the entry into the standby mode.

As shown in FIG. 4A, when, for example, the length of the first time T1 accepted through the input interface 4 is equal to the length of the second time T2, in other words, a third time T3, which is a difference subtracting the second time T2 from the first time T1, is zero (0), the fan 12 may be controlled in the following manners.

In the example shown in FIG. 4A, the first time T1 and the second time T2 may be both set to be two (2) minutes. If the third time T3 is zero (0), the controller 90 inactivates the fan 12 when the fuser 60 finishes fixing the image onto the sheet S, i.e., as soon as the controller 90 shifts from the image forming mode to the standby mode. The fan 12 may stop running from the time of the exit from the image forming mode and throughout the first time T1.

Thus, if the first time T1 is equal to the second time T2, the fan 12 may be inactivated as soon as the controller 90 shifts from the image forming mode to the standby mode so that the noise producible by the running fan 12 may be suppressed through the entire length of the first time T1. While the length of the period, in which the fan 12 is inactivated, is equal to the length of the second time T2, inactivation of the fan 12 may not encourage the temperature in the body 2 to increase beyond the lower range.

For another example, when the first time T1 accepted through the input interface 4 is shorter than the second time T2, that is, when the third time T3 is less than zero (0), in other words, when the third time T3 indicates a negative value, the fan 12 may be controlled in the following manner.

If the third time T3 is less than zero (0), the controller 90 inactivates the fan 12 when the fuser 60 finishes fixing the images onto the sheets S, i.e., when the controller 90 exits the image forming mode and enters the standby mode. The fan 12 may stop running from the time of the exit from the image forming mode and throughout the first time T1. Thus, the fan 12 may be inactivated as soon as the controller 90 shifts from the image forming mode to the standby mode so that a level of the noise producible by the running fan 12 may be suppressed through the entire length of the first time T1. While the fan 12 may be inactivated between the end of the image forming mode and the end of the first time T1, the first time T1 is shorter than the second time T2. Therefore, inactivation of the fan 12 may not encourage the temperature in the body 2 to increase beyond the lower range. Meanwhile, when the third time T3 indicates a value smaller than or equal to zero (0), the controller 90 may inactivate the fan 12 before shifting from the standby mode to the sleep mode. Thus, with the fan 12 being inactivated before entering the sleep mode, the fan 12 may be inactivated in the first time T1 so that the noise producible by the fan 12 may be suppressed to a lower level.

Meanwhile, if no specific preference for the first time T1 is accepted through the input interface 4, the default setting for the first time T1 will serve as the first time T1. In this regard, if the length of the default setting is equal to the second time T2, the controller 90 may inactivate the fan 12 at the end of the image forming mode, in the same manner as the case, where the first time T1 accepted through the input interface 4 is equal to the second time T2. Meanwhile, if the length of the default setting is less than the second time T2, the controller 90 may inactivate the fan 12 at the end of the image forming mode, in the same manner as the case, where the first time T1 accepted through the input interface 4 is less than the second time T2.

Thus, if no specific preference for the first time T1 is accepted through the input interface 4, the fan 12 may be inactivated as soon as the controller 90 shifts from the image forming mode to the standby mode so that the noise producible by the fan 12 may be suppressed to a lower level through the entire length of the first time T1.

In particular, not many users may take time to input preferences for the first time T1; therefore, the noise producible by the fan 12 may often be suppressed to a lower level without specifically changing the settings in the image forming apparatus 1.

As shown in FIG. 4B, when, for another example, the length of the first time T1 accepted through the input interface 4 is longer than the second time T2, or when the default setting for the first time T1 is longer than the second time T2, in other words, when the third time T3 indicates a positive value larger than zero (0), the fan 12 may be controlled in the following manners.

In the example shown in FIG. 4B, the first time T1 is set at four (4) minutes, and the second time T2 and the third time T3 are both set to be two (2) minutes. If the third time T3 is given a positive value, the controller 90 drives the fan 12 continuously from the time when the fuser 60 finishes fixing the image onto the sheet S, i.e., when the controller 90 exits the image forming mode and enters the standby mode, and throughout the third time T3. The controller 90 inactivates the fan 12 when the third time T3 elapses. The fan 13 stays inactive during the second time T2, and when the second time T2 elapses, the controller 90 exits the standby mode. In this regard, the second time T2 is a remainder in the first time T2 after the elapse of the third time T3.

In the example shown in FIG. 4B, the first time T1 is set to have a length, in which lengths of the third time T3 and the second time T2 are equal. The controller 90 may activate the fan 12 in the third time T3, which is a first half of the first time T1, and inactivate the fan 12 in the second time T2, which is a second half of the first time T1.

For another example, as shown in FIG. 4C, the first time T1 may be set to have a length, in which the third time T3 is longer than the second time T2. In the example shown in FIG. 4C, the first time T1 is set to six (6) minutes, the second time T2 is set to two (2) minutes, and the third time T3 is set to four (4) minutes. In this setting, the controller 90 drives the fan 12 continuously while shifting from the image forming mode to the standby mode and throughout the third time T3. The controller 90 inactivates the fan 12 when the third time T3 elapses. The fan 13 stays inactive during the second time T2, and when the second time T2 elapses, the controller 90 exits the standby mode. In this regard, the third time T3 in the example shown in FIG. 4C is longer than the third time T3 in the example shown in FIG. 4B so that the fan 12 is maintained running for a longer period of time.

Thus, when the third time T3 is given a positive value, the fan 12 stays active throughout the third time T3 partially in the first time T1 so that the temperature in the body 2 may be restrained from increasing efficiently. Moreover, the fan 12 stays inactive throughout the second time T2, which occurs after the third time T2 within the first time T1; therefore, the noise producible by the fan 12 may be suppressed without encouraging the temperature in the body 2 to increase beyond the lower range.

<Second Embodiment of Fan Behavior Control in the Standby Mode>

The controller 90 may control behaviors of the fan 12 in the standby mode based on, additionally to the value for the third time T3, the temperature in the body 2, in a flow described in the following paragraphs.

Figure 6:
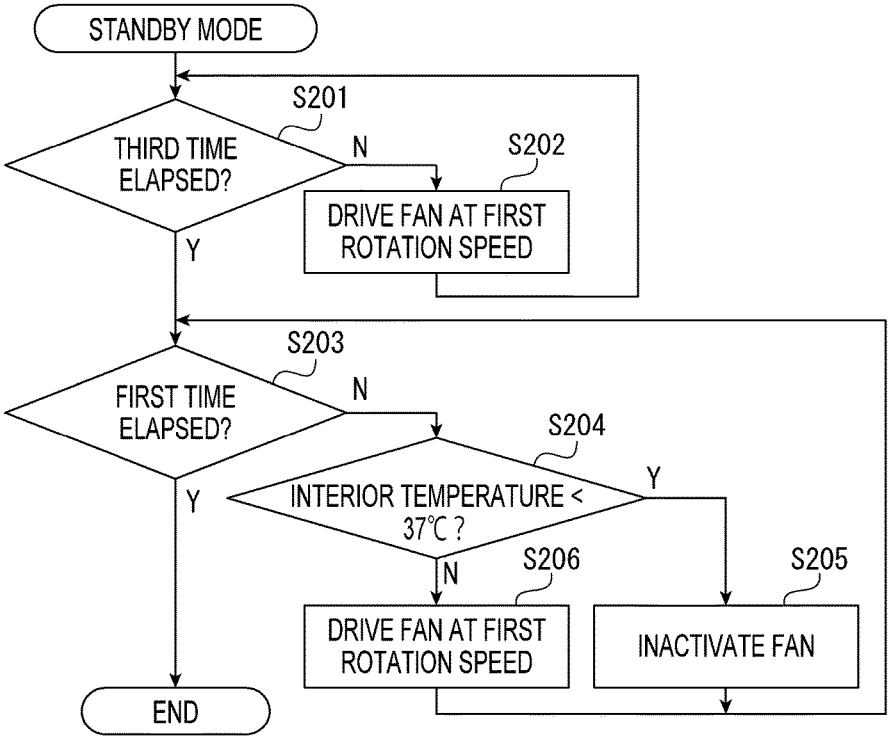
FIG. 6 is a flowchart to illustrate a second exemplary flow of steps to control the fan in the standby mode in the image forming apparatus according to the embodiment of the present disclosure.

As shown in FIG. 6, as the controller 90 shifts from the image forming mode to the standby mode, in S201, the controller 90 determines whether the third time T3 elapsed since the entry into the standby mode (S201).

If the third time T3 has not elapsed (S201: NO), in S202, the controller 90 drives the fan 12 at the first rotation speed. In particular, if the fan 12 was driven to rotate at the first rotation speed at the end of the image forming mode, the fan 12 is driven continuously to rotate at the first rotation speed. On the other hand, if the fan 12 was driven to rotate at the second rotation speed at the end of the image forming mode, the fan 12 is driven to change the rotation speed from the second rotation speed to the first rotation speed.

The controller 90 drives the fan 12 to rotate at the first rotation speed in S202 and returns to S201, in which the controller 90 once again determines whether the third time T3 elapsed since the entry into the standby mode.

In S201, if the controller 90 determines that the third time T3 elapsed (S201: YES), in S203, the controller 90 determines whether the first time T1 has elapsed since the operation mode shifted to the standby mode. If the controller 90 determines that the first time T1 has not elapsed (S203: NO), in S204, the controller 90 determines whether the temperature in the body 2 measured by the interior sensor 15 is lower than 37 degrees C.

If the controller 90 determines that the temperature in the body 2 is lower than 37 degrees C. in S204 (S204: YES), in S205, the controller 90 inactivates the fan 12 and returns to S203, in which the controller 90 once again determines whether the first time T1 elapsed. On the other hand, if the controller 90 determines that the temperature in the body 2 is not lower than 37 degrees C., in other words, the temperature is higher than or equal to 37 degrees C. (S204: NO), in S206, the controller 90 drives the fan 12 at the first rotation speed. The controller 90 drives the fan 12 to rotate at the first rotation speed in S206 and returns to S203, in which the controller 90 once again determines whether the first time T1 elapsed.

In S203, if the controller 90 determines that the first time T1 elapsed (S203: YES), the controller 90 exits the standby mode. In this regard, if the third time T3 is given a value smaller than or equal to zero (0), the controller 90 may determine that the third time T3 elapsed in the first occurrence of S201 since the entry into the standby mode.

According to the flow shown in FIG. 6, the controller 90 drives the fan 12 to rotate at the first rotation speed from the beginning of the standby mode, throughout the third time T3, until the end of the third time T3 regardless of the temperature in the body 2.

Therefore, the controller 90 having driven the fan 12 at the first rotation speed in the image forming mode may continuously drive the fan 12 at the first rotation speed in the standby mode. In other words, the controller 90 may drive the fan 12 at the equal rotation speed in the image forming mode and in the standby mode. Therefore, a blowing rate by the fan 12 in the body 2 may be maintained equally in the image forming mode and in the standby mode. Therefore, for example, even if the second heated temperature by the heat roller 61 is set as high as the first heated temperature, the temperature in the body 2 may be restrained from increasing.

For another example, if the second heated temperature in the heat roller 61 for the standby mode is set to a lower temperature than the first heated temperature for the image forming mode, an increasing rate for the temperature in the body 2 in the standby mode may be smaller than an increasing rate for the temperature in the body in the image forming mode. Therefore, for example, if the controller 90 drives the fan 12 to rotate at the second rotation speed in the image forming mode and at the first rotation speed being a rotation speed lower than the second rotation speed in the standby mode, the temperature in the body 2 may still be restrained from increasing. Moreover, a level of the noise producible by the active fan 12 may be lowered.

For another example, if the second heated temperature in the heat roller 61 is set to a temperature lower than the first heated temperature, and if the fan 12 is driven to rotate at the first rotation speed in the image forming mode, the blowing rate by the fan 12 in the body 2 may be maintained equally in the image forming mode and in the standby mode. Therefore, the temperature in the body 2 may be restrained from increasing more efficiently, and the level of the noise producible by the active fan 12 may be lowered.

According to the flow shown in FIG. 6, when the controller 90 determines that the interior temperature in the body 2 is higher than or equal to 37 degrees C. at the time when the third time T3 during the first time T1 elapses (S204: NO), the controller 90 continuously drive the fan 12 to rotate at the first rotation speed (S206). Therefore, even when the interior temperature in the body 2 is higher than 37 degrees C. at the time when the third time T3 elapses within the first time T1, the fan 12 may be activated to restrain the interior temperature from increasing.

According to the flow shown in FIG. 6, moreover, when the controller 90 determines that the temperature in the body 2 is lower than 37 degrees C. in the second time T2, which occurs after the third time T3 within the first time T1 (S204: YES), the fan 12 is inactivated in S205. Once the temperature in the body 2 is lower than 37 degrees C. in the first time T1, the temperature thereafter tends not to increase even if the fan 12 is inactivated. Therefore, the fan 12 may be inactivated once the temperature in the body 2 is lower than 37 degrees C., and a level of the noise producible by the fan 12 may be lowered.

<Third Embodiment of Fan Behavior Control in the Standby Mode>

In the example shown in FIG. 6, the fan 12 may be driven to rotate at the first rotation speed. In this regard, however, the fan 12 may be driven to rotate at the third rotation speed, which is lower than the first rotation speed, when the second heated temperature in the heat roller 61 is set to be lower than the first heated temperature.

An example of such a flow will be described in the following paragraphs with reference to FIG. 7. In the flowchart shown in FIG. 7, steps S213-S215 are performed similarly to S201 and S213-S215 in the flowchart shown in FIG. 6; therefore, description of those will be omitted, and steps 212 and S216, which are not included in the flowchart in FIG. 6, will be herein described.

In S211, if the controller 90 determines that the third time T3 has not elapsed (S211: NO), in S212, the controller 90 drives the fan 12 to rotate at the third rotation speed. In particular, the rotation speed at the end of the image forming mode, i.e., either the first rotation speed or the second rotation speed, is changed to the third rotation speed.

The controller 90 drives the fan 12 to rotate at the third rotation speed in S212 and returns to S211, in which once again the controller 90 determines whether the third time T3 elapsed since the entry into the standby mode.

In S214, if the controller 90 determines that the temperature in the body 2 is not lower than 37 degrees C., in other words, the temperature is higher than or equal to 37 degrees C. (S214: NO), in S216, the controller 90 drives the fan 12 to rotate at the third rotation speed. The controller 90 drives the fan 12 to rotate at the third rotation speed in S216 and returns to S213, in which once again the controller 90 determines whether the first time T1 elapsed.

Thus, with the fan 12 rotating at the third rotation speed, which is lower than the first rotation speed, in the standby mode, a level of the noise producible by the fan may be lowered. In particular, when the temperature in the heat roller 61 is set to the second heated temperature being lower than the first heated temperature, an increasable range for the temperature in the body 2 may be smaller than an increasable range when the second heated temperature is equal to the first heated temperature. Therefore, even if the fan 12 is driven to rotate at the third rotation speed, which is lower than the first rotation speed, the temperature in the body 2 may be restrained from increasing, and a level of the noise producible by the active fan 12 may be lowered.

Figure 7:
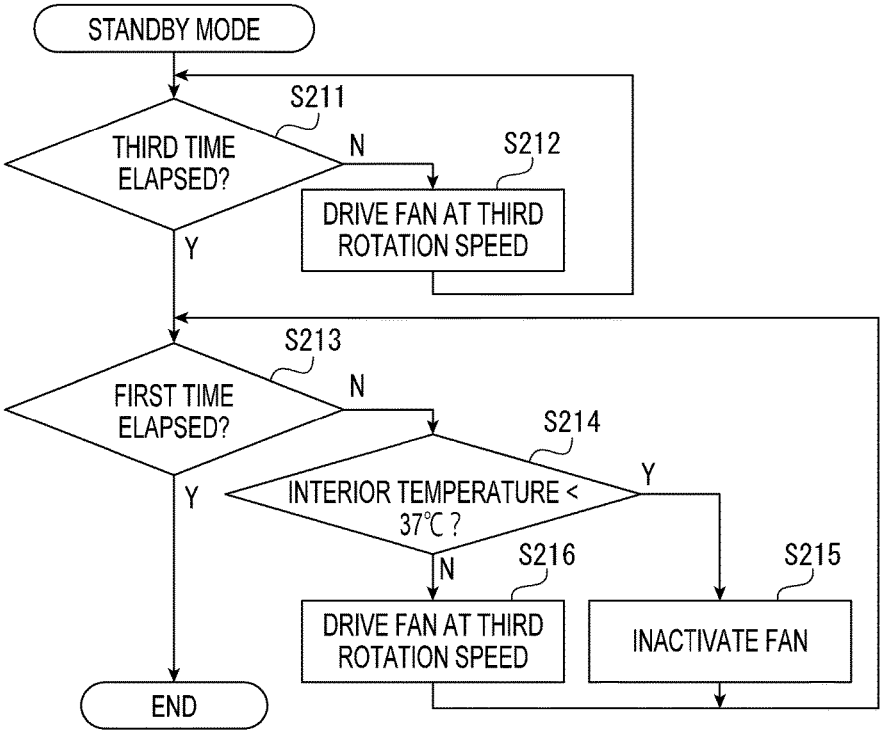
FIG. 7 is a flowchart to illustrate a third exemplary flow of steps to control the fan in the standby mode in the image forming apparatus according to the embodiment of the present disclosure.

Moreover, according to the flow shown in FIG. 7, when the controller 90 determines that the temperature in the body 2 is higher than or equal to 37 degrees C. during the first time T1 in the standby mode (S214: YES), in S216, the fan 12 is controlled to rotate continuously at the third rotation speed. Therefore, if the temperature in the body 2 is higher than 37 degrees C. at the time when the third time T3 elapses within the first time T1, the fan 12 is activated to restrain the temperature from increasing.

Furthermore, if the controller 90 determines that the temperature in the body 2 is lower than 37 degrees C. in the second time T2, which occurs after the third time T3 within the first time T1 (S214: YES), the fan 12 is inactivated in S215. Once the interior temperature is lower than 37 degrees C. during the first time T1, the temperature thereafter tends not to increase even if the fan 12 is inactivated. Therefore, the fan 12 may be inactivated once the interior temperature is lower than 37 degrees C., and a level of the noise producible by the fan 12 may be lowered.

<Fourth Embodiment of Fan-Driving Control in the Standby Mode>

Figure 8:
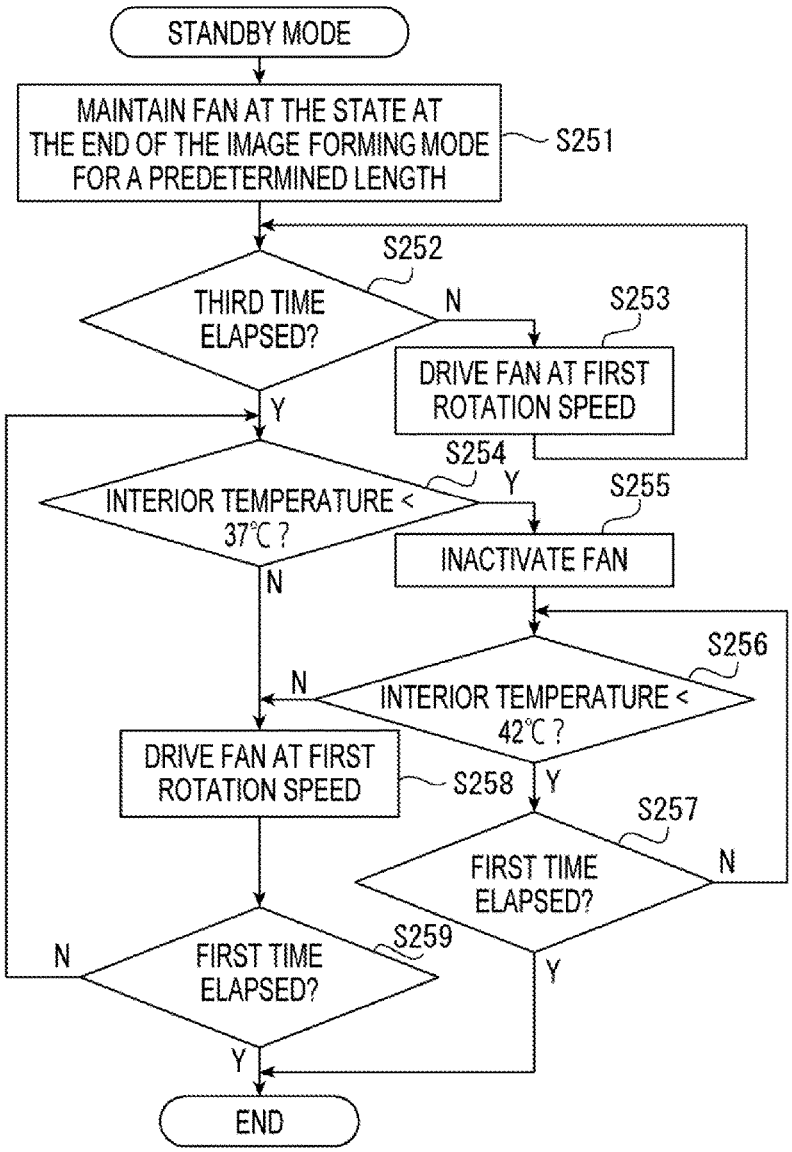
FIG. 8 is a flowchart to illustrate a fourth exemplary flow of steps to control the fan in the standby mode in the image forming apparatus according to the embodiment of the present disclosure.

Optionally, the fan 12 may be controlled during the standby mode in the following manner as shown in FIG. 8. As the controller 90 shifts from the image forming mode to the standby mode, in S251, the controller 90 maintains the condition of the fan 12 at the time when the controller 90 exited the image forming mode, i.e., when the fuser 60 finished fixing an image onto a sheet S, for a predetermined length of period, which may be, for example, six (6) seconds.

For example, the fan 12 may be driven to rotate at the first rotation speed at the end of the image forming mode. In such a case, in S251, the fan 12 is continuously driven to rotate at the first rotation speed for the predetermined length of period in the standby mode. For another example, the fan 12 may be driven to rotate at the second rotation speed at the end of the image forming mode. In this case, in S251, the fan 12 is continuously driven to rotate at the second rotation speed for the predetermined length of period in the standby mode.

When the predetermined length of time elapses since the entry into the standby mode, in S252, the controller 90 determines whether the third time T3 elapsed since the entry into the standby mode.

If the controller 90 determines that the third time T3 has not elapsed (S252: NO), in S253, the controller 90 drives the fan 12 to rotate at the first rotation speed. In particular, if the fan 12 was driven to rotate at the first rotation speed at the end of the image forming mode, the fan 12 is driven continuously to rotate at the first rotation speed. On the other hand, if the fan 12 was driven to rotate at the second rotation speed at the end of the image forming mode, the fan 12 is driven to change the rotation speed from the second rotation speed to the first rotation speed.

The controller 90 drives the fan 12 to rotate at the first rotation speed in S253 and returns to S252, in which once again the controller 90 determines whether the third time T3 elapsed since the entry into the standby mode. In S252, if the controller 90 determines that the third time T3 elapsed (S252: YES), in S254, the controller 90 determines whether the temperature in the body 2 measured by the interior sensor 15 is lower than 37 degrees C.

If the controller 90 determines that the temperature in the body 2 is lower than 37 degrees C. in S254 (S254: YES), in S255, the controller 90 inactivates the fan 12. Thereafter, in S256, the controller 90 determines whether the temperature in the body 2 measured by the interior sensor 15 is lower than 42 degrees C.

If the controller 90 determines that the temperature in the body 2 is lower than 42 degrees C. in S256 (S256: YES), in S257, the controller 90 determines whether the first time T1 has elapsed since the entry into the standby mode. If the controller 90 determines that the first time T1 has not elapsed (S257: NO), the controller 90 returns to S256, in which the controller 90 once again determines whether the first time T1 has elapsed since the entry into the standby mode. If the controller 90 determines that the first time T1 elapsed (S257: YES), the controller 90 exits the standby mode.

Meanwhile, in S254, if the controller 90 determines that the temperature in the body 2 is not lower than 37 degrees C., in other words, the temperature is higher than or equal to 37 degrees C. (S254: NO), in S258, the controller 90 drives the fan 12 to rotate at the first rotation speed. In S259, the controller 90 determines whether the first time T1 elapsed since the entry into the standby mode. If the controller 90 determines that the first time T1 has not elapsed (S259: NO), the controller 90 returns to S254, in which the controller 90 once again determines whether the temperature in the body 2 is lower than 37 degrees C. Meanwhile, in S259, if the controller 90 determines that the first time T1 elapsed (S259: YES), the controller 90 exits the standby mode.

Thus, in S258, the controller 90 drives the fan 12 to rotate at the first rotation speed when the interior temperature in the body 2 is not lower than 42 degrees C., in other words, the temperature is higher than or equal to 42 degrees C. After driving the fan 12 to rotate at the first rotation speed in S258, in S259, the controller 90 determines whether the first time T1 elapsed. If the controller 90 determines that the first time T1 has not elapsed in S259, the controller 90 returns to S254, in which the controller 90 once again determines whether the temperature in the body 2 is lower than 37 degrees C.

Meanwhile, in S259, if the controller 90 determines that the first time T1 elapsed (S259: YES), the controller 90 exits the standby mode.

In this flow, if the third time T3 is given a value smaller than or equal to zero (0), the controller 90 may determine that the third time T3 elapsed in the first occurrence of S252 since the entry into the standby mode.

According to the flow shown in FIG. 8, the controller 90 may restart driving the fan 12 to rotate at the first rotation speed, after inactivating the fan 12 in the second time T2, which occurs later than the third time T3 within the first time T1, when the controller 90 determines that the temperature in the body 2 is higher than or equal to 42 degrees C.

Therefore, if the temperature in the body 2 is once lowered below 37 degrees C. but thereafter increases to be higher than or equal to 42 degrees C. within the first time T1, the fan 12 may be driven to rotate once again at the first rotation speed so that the temperature may be restrained from increasing therefrom. In this flow, the temperature in the body 2, at which the fan 12 should be once again activated, is set to be 42 degrees or higher, rather than 37 degrees or higher, so that the fan 12 may be prevented from being activated and inactivated too frequently.

<Fifth Embodiment of Fan Behavior Control in the Standby Mode>

In the example shown in FIG. 8, the fan 12 may be driven to rotate at the first rotation speed. In this regard, however, the fan 12 may be driven to rotate at the third rotation speed, which is lower than the first rotation speed, when the second heated temperature in the heat roller 61 is set to be lower than the first heated temperature.

Figure 9:
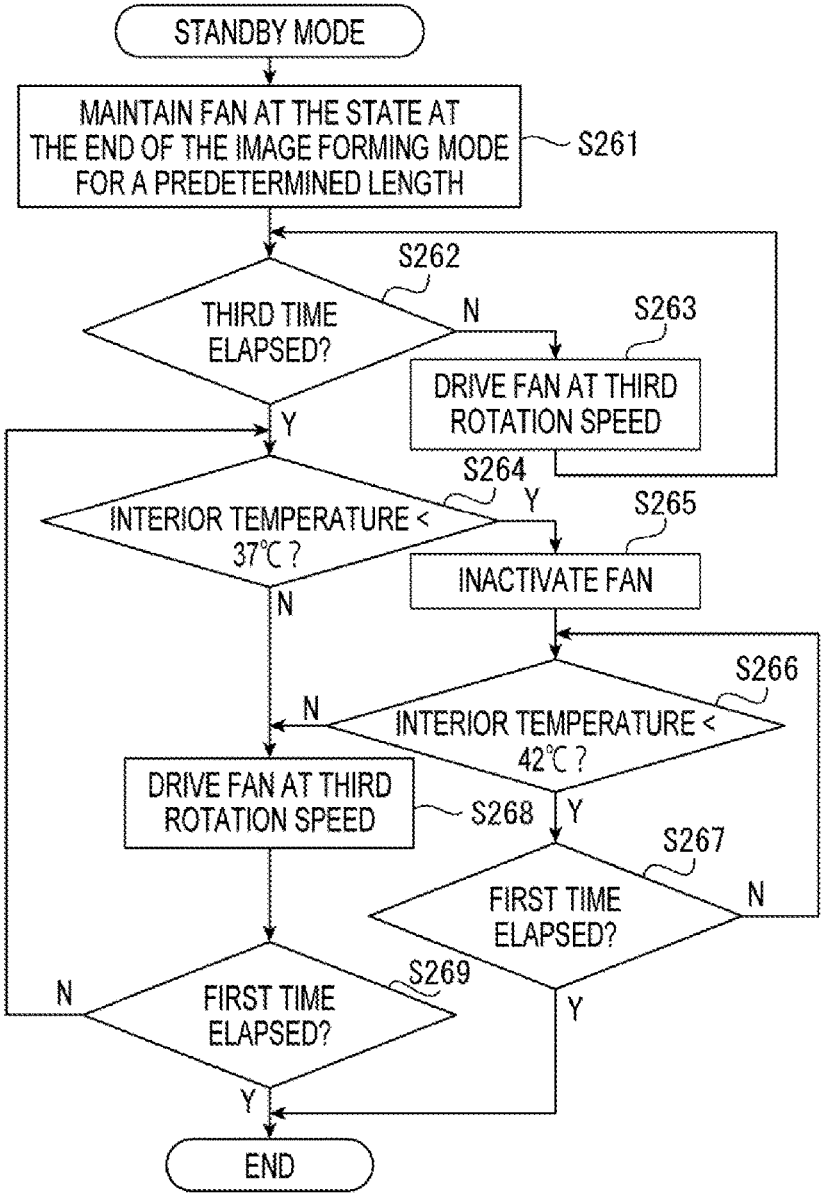
FIG. 9 is a flowchart to illustrate a fifth exemplary flow of steps to control the fan in the standby mode in the image forming apparatus according to the embodiment of the present disclosure.

An example of such a flow will be described in the following paragraphs with reference to FIG. 9. In the flowchart shown in FIG. 9, steps S261-S262, S264-267, and S269 are performed similarly to S251-S252, S254-S257, and S259, respectively, in the flowchart shown in FIG. 8; therefore, description of those will be omitted, and steps 263 and S268, which are not included in the flowchart in FIG. 8, will be herein described.

In S262, if the controller 90 determines that the third time T3 has not elapsed (S262: NO), in S263, the controller 90 drives the fan 12 to rotate at the third rotation speed. In particular, the fan 12 is driven to change the rotation speed from either the first rotation speed or the second rotation speed to the third rotation speed.

The controller 90 drives the fan 12 to rotate at the third rotation speed in S263 and returns to S262, in which once again the controller 90 determines whether the third time T3 elapsed since the entry into the standby mode.

In S264, if the controller 90 determines that the temperature in the body 2 is not lower than 37 degrees C., in other words, the temperature is higher than or equal to 37 degrees C. (S264: NO), in S268, the controller 90 drives the fan 12 to rotate at the third rotation speed. The controller 90 drives the fan 12 to rotate at the third rotation speed, and in S269, the controller 90 determines whether the first time T1 elapsed since the entry into the standby mode.

According to the flow shown in FIG. 9, the controller 90 may restart driving the fan 12 to rotate at the third rotation speed, after inactivating the fan 12 in the second time T2, which occurs later than the third time T3 within the first time T1, when the controller 90 determines that the temperature in the body 2 is higher than or equal to 42 degrees C.

Therefore, if the temperature in the body 2 is once lowered below 37 degrees C. but thereafter increases to be higher than or equal to 42 degrees C. within the first time T1, the fan 12 may be once again driven to rotate at the third rotation speed so that the temperature in the body 2 may be restrained from increasing therefrom. In this flow, the temperature in the body 2, at which the fan 12 should be once again activated, is set to be 42 degrees or higher, rather than 37 degrees or higher, so that the fan 12 may be prevented from being activated and inactivated too frequently.

<First Embodiment of Fan Behavior Control in the Sleep Mode>

When the image forming apparatus 1 is in the sleep mode, heat supply to the heat roller 61 in the fuser 60 is discontinued, and behaviors of the fan 12 are controlled by the controller 90 based on a length of elapsed time since the entry into the sleep mode and a temperature in the body 2.

Figure 10:
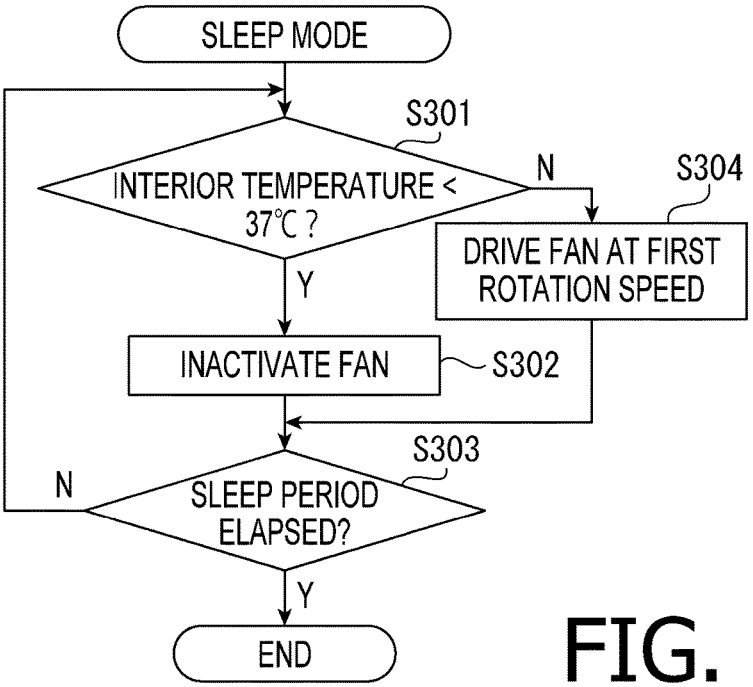
FIG. 10 is a flowchart to illustrate a first exemplary flow of steps to control the fan in a sleep mode in the image forming apparatus according to the embodiment of the present disclosure.

The fan 12 may be controlled by the controller 90 during the sleep mode according to a flow shown in FIG. 10 continuously from the controlling flow in the standby mode shown in either FIG. 6 or FIG. 8.

As shown in FIG. 10, when the controller 90 shifts from the standby mode to the sleep mode, in S301, the controller 90 determines whether the temperature in the body 2 measured by the interior sensor 15 is lower than 37 degrees C. If the controller 90 determines that the temperature in the body 2 is lower than 37 degrees C. in S301 (S301: YES), in S302, the controller 90 inactivates the fan 12. In particular, if the fan 12 was running active when the controller 90 entered the sleep mode, the controller 90 stops the fan 12. Meanwhile, if the fan 12 was inactive when the controller 90 entered the sleep mode, the controller 90 maintains the fan 12 inactive.

A length of a sleep period, for which the sleep mode is to be maintained, is set by the controller 90. The controller 90 inactivates the fan 12 in S302, and in S303, the controller 90 determines whether the sleep period elapsed since the entry into the sleep mode. If the controller 90 determines that the sleep period has not elapsed (S303: NO), the controller 90 returns to S301, in which the controller 90 once again determines whether the temperature in the body 2 is lower than 37 degrees C.

On the other hand, in S303, if the controller 90 determines that the sleep period elapsed (S303: YES), the controller 90 exits the sleep mode. The controller 90 exiting the sleep mode shifts to a deep sleep mode, in which heat supply to the heat roller 61 is discontinued, and many functions in the controller 90 are suspended. In the deep sleep mode, the image forming apparatus 1 consumes even less power than in the sleep mode.

In S301, if the controller 90 determines that the temperature in the body 2 is not lower than 37 degrees C., in other words, the temperature is higher than or equal to 37 degrees C. (S301: NO), in S304, the controller 90 drives the fan 12 to rotate at the first rotation speed. The controller 90 drives the fan 12 to rotate at the first rotation speed, and in S303, the controller 90 determines whether the sleep period elapsed. If the sleep period has not elapsed (S303: NO), the controller 90 returns to S301. If the controller 90 determines that the sleep period elapsed (S301: YES), the controller 90 exits the sleep mode.

Thus, in the sleep mode, heat supply to the heat roller 61 in the fuser 60 is discontinued. Therefore, according to the flow shown in FIG. 10, when the controller 90 shifts from the standby mode to the sleep mode, and if the controller 90 determines whether the temperature in the body 2 is higher than or equal to 37 degrees C., the controller 90 drives the fan 12 to rotate at the first rotation speed. Therefore, even if the temperature in the body 2 is higher than or equal to 37 degrees C. at the time of the entry into the sleep mode, the fan 12 may be activated so that the temperature in the body 2 may restrained from increasing.

<Second Embodiment of Fan Behavior Control in the Sleep Mode>

In the example shown in FIG. 10, the fan 12 may be driven to rotate at the first rotation speed. In this regard, however, the fan 12 may be driven to rotate at the third rotation speed, which is lower than the first rotation speed. An example of such a flow will be described in the following paragraphs with reference to FIG. 11. The fan 12 may be controlled by the controller 90 during the sleep mode according to the flow shown in FIG. 11 continuously from the controlling flow in the standby mode shown in either FIG. 7 or FIG. 9.

Figure 11:
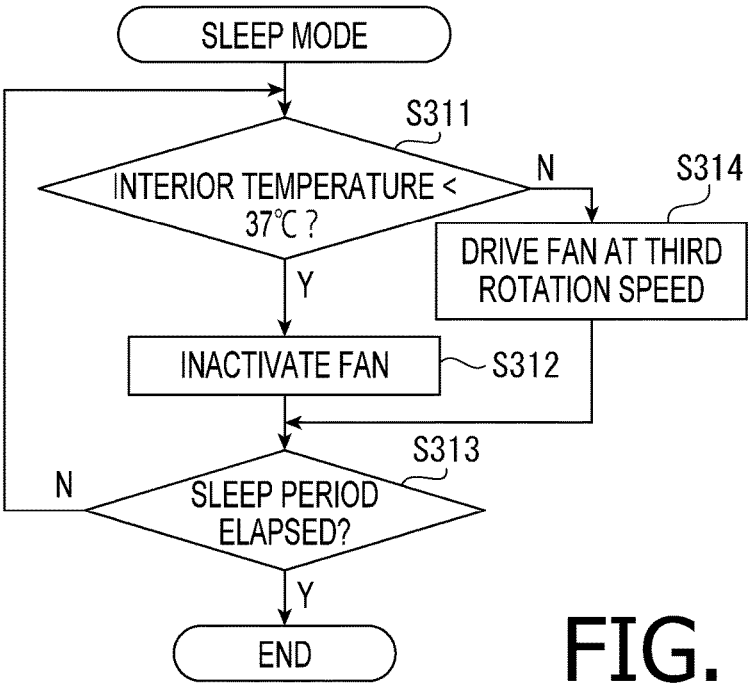
FIG. 11 is a flowchart to illustrate a second exemplary flow of steps to control the fan in the sleep mode in the image forming apparatus according to the embodiment of the present disclosure.

In the flowchart shown in FIG. 11, steps S311-S313 are performed similarly to S301-S303, respectively, in the flowchart shown in FIG. 10; therefore, description of those will be omitted, and step S314, which is not included in the flowchart in FIG. 10, will be herein described.

When the controller 90 is in the sleep mode, heat supply to the heat roller 61 in the fuser 60 is discontinued. In S311, if the controller 90 determines that the temperature in the body 2 is not lower than 37 degrees C., in other words, the temperature is higher than or equal to 37 degrees C. (S311: NO), in S314, the controller 90 drives the fan 12 to rotate at the third rotation speed. The controller 90 drives the fan 12 to rotate at the third rotation speed, and in S313, the controller 90 determines whether the sleep period elapsed.

Thus, in the sleep mode, heat supply to the heat roller 61 in the fuser 60 is discontinued. When the controller 90 shifts from the standby mode to the sleep mode, and if the controller 90 determines the temperature in the body 2 is higher than or equal to 37 degrees C., the controller 90 drives the fan 12 to rotate at the third rotation speed. Therefore, even if the temperature in the body 2 is higher than or equal to 37 degrees C. at the time of the entry into the sleep mode, the fan 12 may be activated so that the temperature in the body 2 may restrained from increasing.

<Third Embodiment of Fan-Driving Control in the Sleep Mode>

Figure 12:
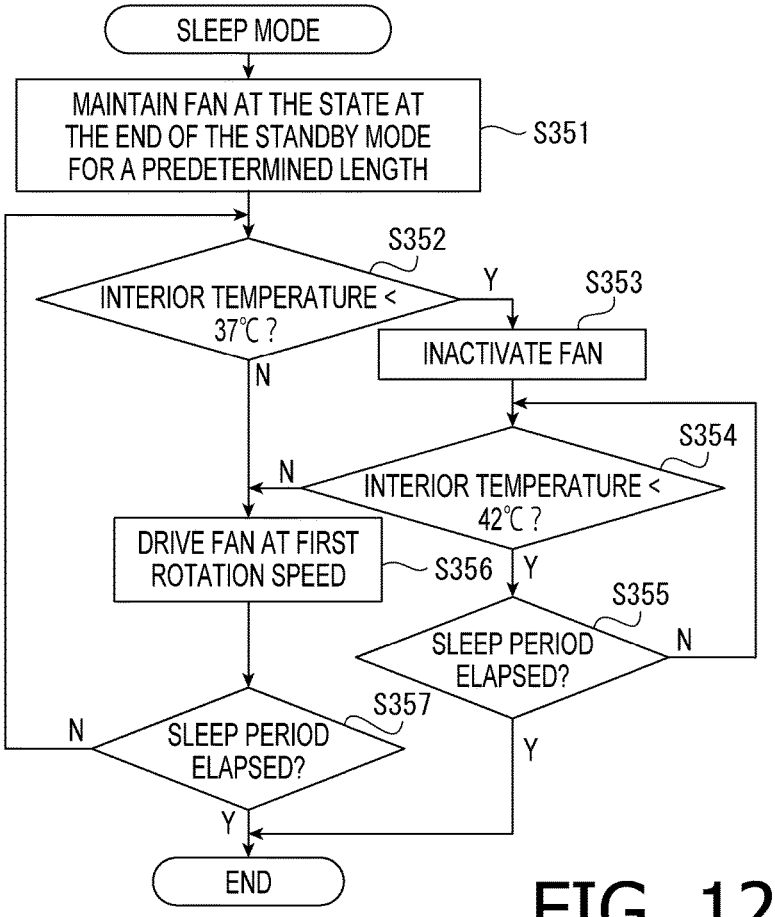
FIG. 12 is a flowchart to illustrate a third exemplary flow of steps to control the fan in the sleep mode in the image forming apparatus according to the embodiment of the present disclosure.

Optionally, the fan 12 may be controlled during the sleep mode in the following manner as shown in FIG. 12. The fan 12 may be controlled by the controller 90 during the sleep mode according to the flow shown in FIG. 12 continuously from the controlling flow in the standby mode shown in either FIG. 6 or FIG. 8.

As shown in FIG. 12, when the controller 90 shifts from the standby mode to the sleep mode, in S351, the controller 90 maintains the condition of the fan 12 at the time when the controller 90 exited the standby mode for a predetermined length of period, which may be, for example, six (6) seconds. For example, the fan 12 may be driven to rotate at the first rotation speed at the end of the standby mode. In such a case, in S351, the fan 12 is continuously driven to rotate at the first rotation speed for the predetermined length of period in the sleep mode. For another example, the fan 12 may be driven at the second rotation speed at the end of the standby mode. In this case, in S351, the fan 12 is continuously driven to rotate at the second rotation speed for the predetermined length of period in the sleep mode.

When the predetermined length of period elapses since the entry into the sleep mode, in S352, the controller 90 determines whether the temperature in the body 2 measured by the interior sensor 15 is lower than 37 degrees C. If the controller 90 determines that the temperature in the body 2 is lower than 37 degrees C. in S352 (S352: YES), and in S353, the controller 90 inactivates the fan 12. In particular, if the fan 12 was running active when the controller 90 entered the sleep mode, the controller 90 stops the fan 12. Meanwhile, if the fan 12 was inactive when the controller 90 entered the sleep mode, the controller 90 maintains the fan 12 inactive.

Thereafter, in S354, the controller 90 determines whether the temperature in the body 2 measured by the interior sensor 15 is lower than 42 degrees C. If the controller 90 determines that the temperature in the body 2 is lower than 42 degrees C. in S354 (S354: YES), in S355, the controller 90 determines whether the sleep period has elapsed since the entry into the sleep mode.

If the controller 90 determines that the sleep period has not elapsed (S355: NO), the controller 90 returns to S354, in which the controller 90 once again determines whether the temperature in the body 2 is lower than 42 degrees C. If the controller 90 determines that the sleep period elapsed (S355: YES), the controller 90 exits the sleep mode. The controller 90 exiting the sleep mode shifts to the deep sleep mode.

Meanwhile, in S352, if the controller 90 determines that the temperature in the body 2 is not lower than 37 degrees C., in other words, the temperature is higher than or equal to 37 degrees C. (S352: NO), in S356, the controller 90 drives the fan 12 to rotate at the first rotation speed. The controller 90 drives the fan 12 to rotate at the first rotation speed and in S357 determines whether the sleep period elapsed.

If the sleep period has not elapsed (S357: NO), the controller 90 returns to S352, in which the controller 90 once again determines whether the temperature in the body 2 is lower than 37 degrees C. If the controller 90 determines that the sleep period elapsed (S357: YES), the controller 90 exits the sleep mode. The controller 90 exiting the sleep mode shifts to the deep sleep mode.

In S354, if the controller 90 determines that the temperature in the body 2 is not lower than 42 degrees C., in other words, the temperature is higher than or equal to 42 degrees C. (S354: NO), in S356, the controller 90 drives the fan 12 to rotate at the first rotation speed. The controller 90 drives the fan 12 to rotate at the first rotation speed, and in S357 determines whether the sleep period elapsed. If the controller 90 determines that the sleep period has not elapsed (S357: NO), the controller 90 returns to S352, in which the controller 90 once again determines whether the temperature in the body 2 is lower than 37 degrees C. In S357, if the controller 90 determines that the sleep period elapsed (S357: YES), the controller 90 exits the sleep mode.

According to the flow shown in FIG. 12, the controller 90 may restart driving the fan 12 to rotate at the first rotation speed, after inactivating the fan 12 since the entry into the sleep mode, when the controller 90 determines that the temperature in the body 2 is not lower than 42 degrees C., in other words, the temperature is higher than or equal to 42 degrees C. (S354: NO).

Therefore, if the temperature in the body 2 is once lowered below 37 degrees C. but thereafter increases to be higher than or equal to 42 degrees C. during the sleep mode, the fan 12 may be once again driven to rotate at the first rotation speed so that the temperature may be restrained from increasing therefrom. In this flow, the temperature in the body 2, at which the fan 12 should be once again activated, is set to be 42 degrees or higher, rather than 37 degrees or higher, so that the fan 12 may be prevented from being activated and inactivated too frequently.

<Fourth Embodiment of Fan-Driving Control in the Sleep Mode>

In the example shown in FIG. 12, the fan 12 may be driven to rotate at the first rotation speed. In this regard, however, the fan 12 may be driven to rotate at the third rotation speed, which is lower than the first rotation speed. An example of such a flow will be described in the following paragraphs with reference to FIG. 13. The fan 12 may be controlled by the controller 90 during the sleep mode according to the flow shown in FIG. 13 continuously from the controlling flow in the standby mode shown in either FIG. 7 or FIG. 9.

Figure 13:
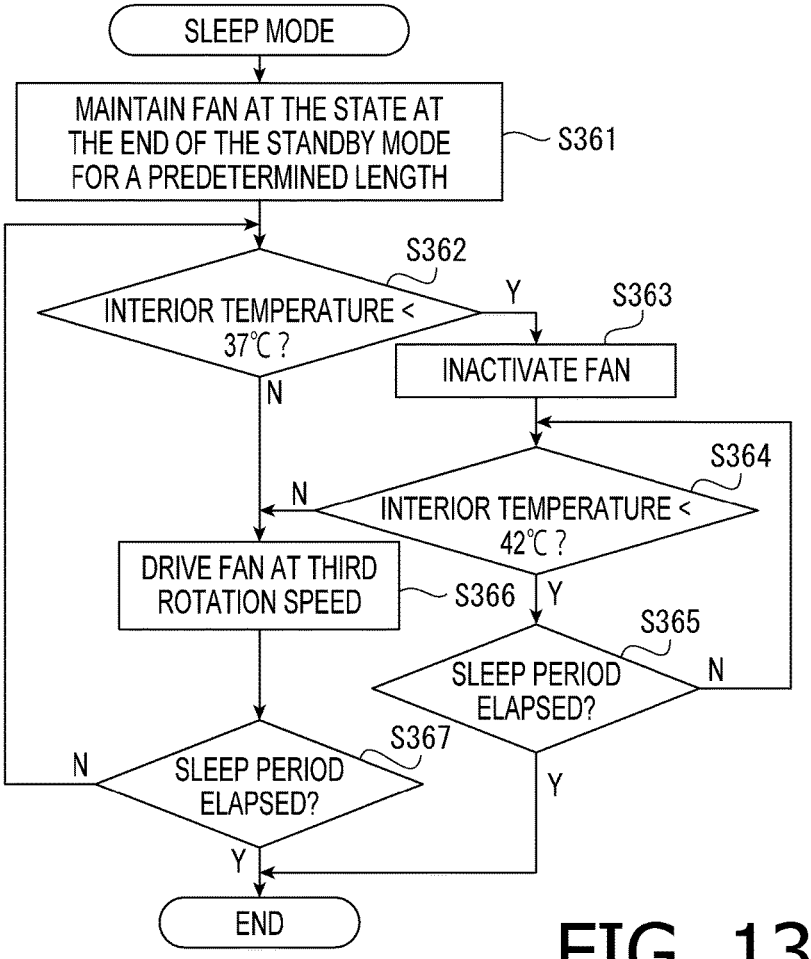
FIG. 13 is a flowchart to illustrate a fourth exemplary flow of steps to control the fan in the sleep mode in the image forming apparatus according to the embodiment of the present disclosure.

In the flowchart shown in FIG. 13, steps S361-S365 and S367 are performed similarly to S351-S355 and S357, respectively, in the flowchart shown in FIG. 12; therefore, description of those will be omitted, and step S366, which is not included in the flowchart in FIG. 12, will be herein described.

If the controller 90 determines that the temperature in the body 2 is not lower than 37 degrees C., in other words, the temperature is higher than or equal to 37 degrees C. (S362: NO), in S366, the controller 90 drives the fan 12 to rotate at the third rotation speed. The controller 90 drives the fan 12 to rotate at the third rotation speed, and in S367, determines whether the sleep period elapsed.

In S364, if the controller 90 determines that the temperature in the body 2 is not lower than 42 degrees C., in other words, the temperature is higher than or equal to 42 degrees C. (S364: NO), in S366, the controller 90 drives the fan 12 to rotate at the third rotation speed. The controller 90 drives the fan 12 to rotate at the third rotation speed and in S367 determines whether the sleep period elapsed.

According to the flow shown in FIG. 13, the controller 90 may restart driving the fan 12 to rotate at the third rotation speed when the controller 90 determines that the temperature in the body 2 is not lower than 42 degrees C., in other words, the temperature is higher than or equal to 42 degrees C. (S364: NO).

Therefore, if the temperature in the body 2 is once lowered below 37 degrees C. but thereafter increases to be higher than or equal to 42 degrees C. during the sleep mode, the fan 12 may be once again driven to rotate at the third rotation speed so that the temperature may be restrained from increasing therefrom. In this flow, the temperature in the body 2, at which the fan 12 should be once again activated, is set to be 42 degrees or higher, rather than 37 degrees or higher, so that the fan 12 may be prevented from being activated and inactivated too frequently.

[Changing the Second Time in the Standby Mode According to Exterior Temperature]

The controller 90 in the image forming apparatus 1 may change the length of the second time T2 in the standby mode according to an exterior temperature outside the body 2. For example, the controller 90 may determine that the exterior temperature measured by the exterior temperature sensor 16 is lower than or equal to a third predetermined temperature, which may be set in advance. In such a case, the controller 90 may increase the value for the second time. The third predetermined temperature may be, for example, 10 degrees C. When the exterior temperature is relatively low, that is, lower than the third predetermined temperature, the interior temperature in the body 2 may not increase easily. Therefore, even if the second time T2, in which the fan 12 is inactivated, is extended, the extended second time T2 may not encourage the temperature in the body 2 to increase beyond the lower range.

Moreover, within the first time T1 in the standby mode, extending the second time T2 may shorten the third time T3. Therefore, a period, in which the fan 12 is activated within the first time T1, may be shortened. Accordingly, for example, if the image forming apparatus 1 is used in a colder region, in which the exterior temperature is generally lower, a level of the noise producible by the fan 12 may be lowered.

Furthermore, the controller 90 may be configured to determine whether the exterior temperature measured by the exterior sensor 16 is higher or equal to a fourth predetermined temperature. If the controller 90 determines that the exterior temperature is higher or equal to the fourth predetermined temperature, the value for the second time T2 may be reduced. The fourth predetermined temperature may be, for example, 32.5 degrees C. When the exterior temperature is relatively high, that is, higher than or equal to the fourth predetermined temperature, the interior temperature in the body 2 may increase easily. Therefore, the second time T2, in which the fan 12 is inactivated, may be shortened so that the interior temperature may be restrained from increasing.

Moreover, within the first time T1 in the standby mode, shortening the second time T2 may extend the third time T3. Therefore, a period, in which the fan 12 is activated within the first time T1, may be extended. Accordingly, for example, if the image forming apparatus 1 is used in a warmer region, in which the exterior temperature is generally higher, a level of the noise producible by the fan 12 may be effectively lowered.

Although examples of carrying out the invention have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An image forming apparatus, comprising:

a body;

a fuser stored in the body, the fuser comprising a heater, the fuser being configured to heat a recording medium, onto which an image is transferred, by the heater to fix the image on the recording medium;

an interface configured to accept a value for a first time, the first time being a length of time from an end of fixing the image on the recording medium by the fuser until entry into a low power-consuming condition for the heater;

a fan configured to ventilate the body; and a controller configured to set a second time being a predetermined length and obtain a third time, the third time being a remainder of subtraction subtracting the second time from the first time accepted by the interface, the controller being configured to:

in a case where the third time is given a positive value, continue driving the fan after the end of the fixing and throughout the third time, and inactivate the fan after the third time; and in a case where the third time is given a value smaller than or equal to zero, inactivate the fan during the first time before the entry into the low power-consuming condition.

2. The image forming apparatus according to claim 1, wherein the controller is configured to, in the case where the third time is given the value smaller than or equal to zero, inactivate the fan at the end of the fixing.

3. The image forming apparatus according to claim 1, wherein an initial value for the first time is set to be equal to a value for the second time; and wherein the controller is configured to, in a case where no value for the first time is accepted by the interface, inactivate the fan at the end of the fixing.

4. The image forming apparatus according to claim 1, wherein the controller is configured to drive the fan during the first time to rotate at a rotation speed equal to a rotation speed of the fan during the fixing.

5. The image forming apparatus according to claim 1, wherein the controller is configured to drive the fan during the first time to rotate at a rotation speed lower than a rotation speed of the fan during the fixing.

6. The image forming apparatus according to claim 1, further comprising:

an interior temperature measurer configured to measure a temperature inside the body, wherein the fuser is heated during the first time by heat in a temperature lower than a heating temperature to heat the fuser during the fixing;

wherein the controller is configured to:

in a case where the controller determines that the temperature inside the body measured by the interior temperature measurer during the fixing is lower than a first predetermined temperature, drive the fan to rotate at a first rotation speed;

in a case where the controller determines that the temperature inside the body measured by the interior temperature measurer during the fixing is higher than or equal to the first predetermined temperature, drive the fan to rotate at a second rotation speed, the second rotation speed being higher than the first rotation speed; and drive the fan to rotate at the first rotation speed in a period from a beginning of the first time until an end of the third time regardless of the temperature inside the body.

7. The image forming apparatus according to claim 6, wherein the controller is configured to, in a case where the controller determines that the temperature inside the body is higher than or equal to the first predetermined temperature at the end of the third time within the first time, drive the fan to continuously rotate at the first rotation speed.

8. The image forming apparatus according to claim 6, wherein the controller is configured to, in a case where the controller determines that the temperature inside the body is lower than the first predetermined temperature during the second time, the second time occurring within the first time after the end of the third time, inactivate the fan.

9. The image forming apparatus according to claim 8, wherein the controller is configured to, after inactivating the fan during the second time within the first time, in a case where the temperature inside the body is higher than or equal to a second predetermined temperature, the second predetermined temperature being higher than the first predetermined temperature, restart driving the fan to rotate at the first rotation speed.

10. The image forming apparatus according to claim 6, wherein heating by the heater in the fuser is stopped while the fuser is in the low power-consuming condition; and wherein the controller is configured to, in a case where the controller determines at the time of shifting from the first time to the low power-consuming condition that the temperature inside the body is higher than or equal to the first predetermined temperature, drive the fan to rotate at the first rotation speed.

11. The image forming apparatus according to claim 1, further comprising:

an interior temperature measurer configured to measure a temperature inside the body, wherein the fuser is heated during the first time by heat in a temperature lower than a heating temperature to heat the fuser during the fixing;

wherein the controller is configured to:

in a case where the controller determines that the temperature inside the body measured by the interior temperature measurer during the fixing is lower than a first predetermined temperature, drive the fan to rotate at a first rotation speed;

in a case where the controller determines that the temperature inside the body measured by the interior temperature measurer during the fixing is higher than or equal to the first predetermined temperature, drive the fan to rotate at a second rotation speed, the second rotation speed being higher than the first rotation speed; and drive the fan to rotate at a third rotation speed, the third rotation speed being lower than the first rotation speed, in a period from a beginning of the first time until an end of the third time regardless of the temperature inside the body.

12. The image forming apparatus according to claim 11, wherein the controller is configured to, in a case where the controller determines that the temperature inside the body is higher than or equal to the first predetermined temperature at the end of the third time within the first time, drive the fan to continuously rotate at the third rotation speed.

13. The image forming apparatus according to claim 11, wherein the controller is configured to, in a case where the controller determines that the temperature inside the body is lower than the first predetermined temperature during the second time, the second time occurring within the first time after the end of the third time, inactivate the fan.

14. The image forming apparatus according to claim 13, wherein the controller is configured to, after inactivating the fan during the second time within the first time, in a case where the temperature inside the body is higher than or equal to a second predetermined temperature, the second predetermined temperature being higher than the first predetermined temperature, restart driving the fan to rotate at the third rotation speed.

15. The image forming apparatus according to claim 11, wherein heating by the heater in the fuser is stopped while the fuser is in the low power-consuming condition; and wherein the controller is configured to, in a case where the controller determines at the time of shifting from the first time to the low power-consuming condition that the temperature inside the body is higher than or equal to the first predetermined temperature, drive the fan to rotate at the third rotation speed.

16. The image forming apparatus according to claim 1, further comprising:

an exterior temperature measurer configured to measure a temperature outside the body, wherein the controller is configured to, in a case where the controller determines that the temperature outside the body measured by the exterior temperature measurer is lower than or equal to a predetermined exterior temperature, increase a value of the second time.

17. The image forming apparatus according to claim 1, further comprising:

an exterior temperature measurer configured to measure a temperature outside the body, wherein the controller is configured to, in a case where the controller determines that the temperature outside the body measured by the exterior temperature measurer is higher than or equal to a predetermined exterior temperature, lower a value of the second time.

* * * * *